US006956504B2

(12) United States Patent
Shintani

(10) Patent No.: US 6,956,504 B2
(45) Date of Patent: Oct. 18, 2005

(54) TRANSPORT VEHICLE SERVICE GUIDING SYSTEM, TRANSPORT VEHICLE SERVICE GUIDING METHOD, AND TRANSPORT VEHICLE SERVICE GUIDING PROGRAM

(75) Inventor: Tatsuyuki Shintani, Tokyo (JP)

(73) Assignee: NEC Corporation, Tokyo (JP)

( * ) Notice: Subject to any disclaimer, the term of this patent is extended or adjusted under 35 U.S.C. 154(b) by 148 days.

(21) Appl. No.: 10/705,856

(22) Filed: Nov. 13, 2003

(65) Prior Publication Data

US 2004/0095260 A1 May 20, 2004

(30) Foreign Application Priority Data

Nov. 20, 2002 (JP) ..... 2002-337233

(51) Int. Cl.[7] ..... G08G 1/123
(52) U.S. Cl. ..... 340/994; 340/539.11; 340/539.2
(58) Field of Search ..... 340/994, 992, 340/993, 995.19, 539.11, 539.13, 539.2; 701/1, 23, 24, 25

(56) References Cited

U.S. PATENT DOCUMENTS 4,799,162 A * 1/1989 Shinkawa et al. ..... 701/117
5,557,522 A * 9/1996 Nakayama et al. ..... 701/200
5,739,774 A * 4/1998 Olandesi ..... 340/994
5,765,123 A * 6/1998 Nimura et al. ..... 701/208
6,097,317 A * 8/2000 Lewiner et al. ..... 340/994
6,184,802 B1 * 2/2001 Lamb ..... 340/994
6,492,912 B1 * 12/2002 Jones ..... 340/994
6,618,668 B1 * 9/2003 Laird ..... 701/204
6,816,778 B2 * 11/2004 Diaz ..... 701/200

FOREIGN PATENT DOCUMENTS

JP 2001-331888 A 11/2001
JP 2002-48587 A 2/2002

* cited by examiner

*Primary Examiner*—Toan N. Pham
(74) *Attorney, Agent, or Firm*—Sughrue Mion, PLLC

(57) ABSTRACT

A bus service guiding system is provided which enables a user to certainly get on a target shuttle bus or a like and to certainly get off of the shuttle bus at a target bus stop without transmitting and receiving intense radio waves in a vehicle. A user terminal receives an e-mail address of an information providing service center from a queried-object notifying section and transmits a request for guidance information and information about destination containing keywords. The information providing service center searches for a most suitable get-off bus stop out of bus stops associated with keywords and retrieves or performs computations related information to create guidance information, and transmits the created guidance information to the user terminal. At a time of getting on, Guidance information and a get-off guidance request are transmitted from the user terminal by using Bluetooth technology. A vehicle-installed guidance server transmits get-off guidance information with specified timing based on a run-distance and vibration by a vibrating section which prompts the user to get off of the shuttle bus.

26 Claims, 10 Drawing Sheets

TRANSPORT VEHICLE SERVICE GUIDING SYSTEM, TRANSPORT VEHICLE SERVICE GUIDING METHOD, AND TRANSPORT VEHICLE SERVICE GUIDING PROGRAM

BACKGROUND OF THE INVENTION

1. Field of the Invention

The present invention relates to a transport vehicle service guiding system and a transport vehicle service guiding method adapted to provide service guiding information about a transport vehicle such as a shuttle bus or a like in response to a request from a user using, for example, aportable cellular phone, and a transport vehicle service guiding program to have a computer perform the above transport vehicle service guiding method.

The present application claims priority of Japanese Patent Application No. 2002-337233 filed on Nov. 20, 2002, which is hereby incorporated by reference.

2. Description of the Related Art

Conventionally, in many cases, a user of a public transport vehicle such as a shuttle bus or a like checks which bus stop is nearest to a destination by viewing, for example, a timetable, a route map, or a like being put on a guide plate at a bus stop and, when the user can visually identify an approach of a shuttle bus operating by way of the bus stop nearest to the destination, again checks a designation display or a like of the shuttle bus and gets on the shuttle bus and then gets out of the shuttle bus at the bus stop nearest to the destination that the user has targeted in advance. However, there is a problem in that, though the user can conveniently utilize such a shuttle bus at a low fare, unless the user has information about a bus stop being nearest to a destination, the user cannot check whether a shuttle bus passing through the bus stop where the user exists presently passes through a place being near to the destination only by checking a route map or a like on a guide board at a bus stop and the user, after having gotten on the shuttle bus, finds out that the user got on a wrong shuttle bus.

Moreover, there is another problem in that, even if the user knows a bus stop being nearest to a destination, when there are many bus stops on a route, since a description of the bus stop may be omitted on a route map in some cases, the user may be at a loss how to search for the target bus stop.

Furthermore, there is still another problem in that, when the user uses a shuttle bus in a place where the user is a stranger there, even if the user can get on the shuttle bus passing through a bus stop nearest to a destination, the user fails to listen to a broadcast about an internal guidance and may ride past the user's destination bus stop. Thus, cases occur where it is difficult for the user to certainly get on the target bus or to certainly get out of the bus at the target bus stop.

To solve these problems, a guiding system is disclosed in, for example, in Japanese Patent Application Laid-open No. 2002-48587 in which a user of a shuttle bus inputs information about a destination into the guiding system through a portable cellular phone of the user in advance and, when the user's portable cellular phone receives guidance data from the guiding system installed within the shuttle bus at time of an approach of the shuttle bus, the guidance data is verified against the information about the destination and, if the approaching shuttle bus is judged to be a target shuttle bus, a result from its judgement is displayed on the user's portable cellular phone and when the shuttle bus, after the user has gotten on the shuttle bus, approaches a bus stop that the user has to get off, the user's portable cellular phone receives guidance data from the guiding system installed within the shuttle bus and displays a get-off guidance.

Also, another guiding system is disclosed in, for example, Japanese Patent Application Laid-open No. 2001-331888 in which, when a user operates a portable cellular phone to make access to a route guiding system within a vehicle and designates a destination, the route guiding system within the vehicle searches for the destination and stores information about the corresponding route guidance and continues to transmit information about guidance including relay guidance, arrival guidance, or a like until the user reaches the destination.

However, all the above conventional guiding systems have a problem in that comparatively intense radio waves transmitted or received within a vehicle such as a shuttle bus do harm to users of some of medical apparatuses being used in a same shuttle bus.

SUMMARY OF THE INVENTION

In view of the above, it is an object of the present invention to provide a transport vehicle service guiding system capable of guiding a user of a shuttle bus or a like so as to certainly get on the shuttle bus or a like operating by way of a destination or to certainly get out of the shuttle bus or a like at a target bus stop without transmitting or receiving radio waves being intense enough to adversely affect operations of, for example, some of medical apparatuses being used within the shuttle bus or a like, a transport vehicle service guiding method, and a transport vehicle service guiding program.

According to a first aspect of the present invention, there is provided a transport vehicle service guiding system for providing a user with guidance information about a transport vehicle running on a regular route to have the user get on or off at any one of specified vehicle stops, the guiding system including:

a user terminal being movable and to be used by the user, a guidance information providing center to provide the guidance information in response to a request from the user terminal, which is able to carry out communications with the user terminal through a network;

a vehicle-installed communicating unit being mounted on the transport vehicle and being able to carry out communications with the user terminal at least within the transport vehicle;

wherein the user terminal transmits information about a destination to the guidance information providing center through the network and makes a request for corresponding the guidance information;

wherein the guidance information providing center, in response to a request from the user terminal, provides the guidance information to the user terminal through the network; and wherein the vehicle-installed communicating unit, when having received a get-off guidance request created based on the guidance information from the user terminal, transmits get-off guidance information to the user terminal.

In the foregoing, a preferable mode is one wherein the vehicle-installed communicating unit is able to carry out near-distance communications in which a communication range is limited to an inside and vicinity of the transport vehicle, with the user terminal.

Also, a preferable mode is one wherein the user terminal and the vehicle-installed communicating unit transmit and receive specified information by communications using Bluetooth technology or by infrared communications.

Also, a preferable mode is one wherein the information about a destination contains keywords related to the destination.

Also, a preferable mode is one that wherein includes a queried-object notifying unit being placed in at least one of specified vehicle stops for the transport vehicle and used to notify queried-object information of the guidance information providing center.

Also, a preferable mode is one wherein the queried-object notifying unit, in response to a request from the user terminal, transmits the queried-object information to the user terminal.

Also, a preferable mode is one wherein the vehicle-installed communicating unit, based on a run-distance of the transport vehicle, when the transport vehicle approaches a destination, transmits the get-off guidance information to the user terminal.

According to a second aspect of the present invention, there is provided a transport vehicle service guiding system for providing a user with guidance information about a transport vehicle running on a regular route to have the user get on or off at any one of specified vehicle stops, the guiding system including:

a user terminal being movable and to be used by the user, a guidance information providing center to provide the guidance information about the transport vehicle in response to a request from the user terminal, which is able to carry out communications with the user terminal through a network;

wherein the user terminal transmits information about a destination through the network to the guidance information providing center and makes a request for corresponding the guidance information and, based on provided guidance information, determines timing for guiding the user in getting out of the transport vehicle and, when the transport vehicle approaches the destination, gives notification to prompt the user to prepare for getting out of the transport vehicle.

According to a third aspect of the present invention, there is provided a transport vehicle service guiding method for providing a user with guidance information about a transport vehicle running on a regular route to have the user get on or off at any one of specified vehicle stops, the guiding method including:

a step of carrying out communications by connecting, through a network, a user terminal being movable and to be used by the user to a guidance information providing center to provide the guidance information about the transport vehicle in response to a request from the user terminal;

a step of carrying out communications between a vehicle-installed communicating unit being mounted on the transport vehicle and the user terminal at least within the transport vehicle;

wherein the user terminal transmits information about a destination to the guidance information providing center through the network and makes a request for corresponding the guidance information;

wherein the user terminal transmits information about a destination to the guidance information providing center through the network and makes a request for corresponding the guidance information;

wherein the guidance information providing center, in response to the request from the user terminal, provides the guidance information through the network to the user terminal; and wherein the vehicle-installed communicating unit, when having received a request for get-off guidance created based on the guidance information from the user terminal, transmits get-off guidance information to the user terminal.

In the foregoing, a preferable mode is one wherein the vehicle-installed communicating unit is able to carry out near-distance communications in which a communication range is limited to an inside and vicinity of the transport vehicle, with the user terminal.

Also, a preferable mode is one wherein the user terminal and the vehicle-installed communicating unit transmit and receive specified information by communications using Bluetooth technology or by infrared communications.

Also, a preferable mode is one wherein the information about a destination contains keywords related to the destination.

Also, a preferable mode is one wherein a queried-object notifying unit being placed in at least one of specified vehicle stops for the transport vehicle notifies queried-object information of the guidance information providing center.

Also, a preferable mode is one wherein the queried-object notifying unit, in response to a request from the user terminal, transmits the queried-object information to the user terminal.

Also, a preferable mode is one wherein the vehicle-installed communicating unit, based on a run-distance of the transport vehicle, when the transport vehicle approaches a destination, transmits the get-off guidance information to the user terminal.

According to a fourth aspect of the present invention, there is provided a transport vehicle service guiding method for providing a user with guidance information about a transport vehicle running on a regular route to have the user get on or off at any one of specified vehicle stops, the guiding method including:

a step of carrying out communications by connecting, via a network, a user terminal being movable and to be used by the user to a guidance information providing center to provide the guidance information about a transport vehicle in response to a request from the user terminal; and wherein the user terminal transmits information about a destination through the network to the guidance information providing center and makes a request for corresponding the guidance information about the transport vehicle and, based on provided guidance information, determines timing for guiding the user in getting out of the transport vehicle and, when the transport vehicle approaches the destination, gives notification to prompt the user to prepare for getting out of the transport vehicle.

According to a fifth aspect of the present invention, there is provided a transport vehicle service guiding program to have a computer execute a transport vehicle service guiding method for providing a user with guidance information about a transport vehicle running on a regular route to have the user get on or off at any one of specified vehicle stops, the guiding method including:

a step of carrying out communications by connecting, through a network, a user terminal being movable and to be used by the user to a guidance information providing center to provide the guidance information about the transport vehicle in response to a request from the user terminal;

a step of carrying out communications between a vehicle-installed communicating unit being mounted on the transport vehicle and the user terminal at least within the transport vehicle;

wherein the user terminal transmits information about a destination to the guidance information providing center through the network and makes a request for corresponding the guidance information;

wherein the user terminal transmits information about a destination to the guidance information providing center through the network and makes a request for corresponding the guidance information;

wherein the guidance information providing center, in response to the request from the user terminal, provides the guidance information through the network to the user terminal; and wherein the vehicle-installed communicating unit, when having received a request for get-off guidance created based on the guidance information from the user terminal, transmits get-off guidance information to the user terminal.

According to a sixth aspect of the present invention, there is provided a transport vehicle service guiding program to have a computer execute a transport vehicle service guiding method for providing a user with guidance information about a transport vehicle running on a regular route to have the user get on or off at any one of specified vehicle stops, the guiding method including:

a step of carrying out communications by connecting, via a network, a user terminal being movable and to be used by the user to a guidance information providing center to provide the guidance information about a transport vehicle in response to a request from the user terminal; and wherein the user terminal transmits information about a destination through the network to the guidance information providing center and makes a request for corresponding the guidance information about the transport vehicle and, based on provided guidance information, determines timing for guiding the user in getting out of the transport vehicle and, when the transport vehicle approaches the destination, gives notification to prompt the user to prepare for getting out of the transport vehicle.

With the above configuration, a user of a transport vehicle, by receiving guidance information about a transport vehicle corresponding to destination information from a guidance information providing center, can certainly get on a transport vehicle running by way of the destination and, when the user approaches a get-off place, by receiving get-off guidance information from a vehicle-installed communication unit, can certainly get out of the transport vehicle without riding past the destination even in an unfamiliar area.

With another configuration as above, a user terminal, in a shuttle bus or a like, receives get-off guidance information by carrying out comparatively near distance communications using, for example, Bluetooth technology or communications such as infrared communications or a like with the vehicle-installed communication unit and, therefore, radio waves being so intense that it can adversely affect operations of some medical apparatuses are not transmitted or received within the transport vehicle, which does no harm to a user of some medical apparatuses existing in a same vehicle accordingly.

With still another configuration as above, since a request for guidance information is made for retrieval by transmitting associated keywords as destination information even when an exact name of a facility or place, or a like is unknown, it is possible to obtain precise guidance information.

With still another configuration as above, since queried-object information of a guidance information providing center is automatically received from the queried-object notifying unit when access is made from a user terminal to the guidance information providing center, it is made possible to simply and rapidly make a request asking the guidance information providing center to provide guidance information.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Embodiment

Figure 1:
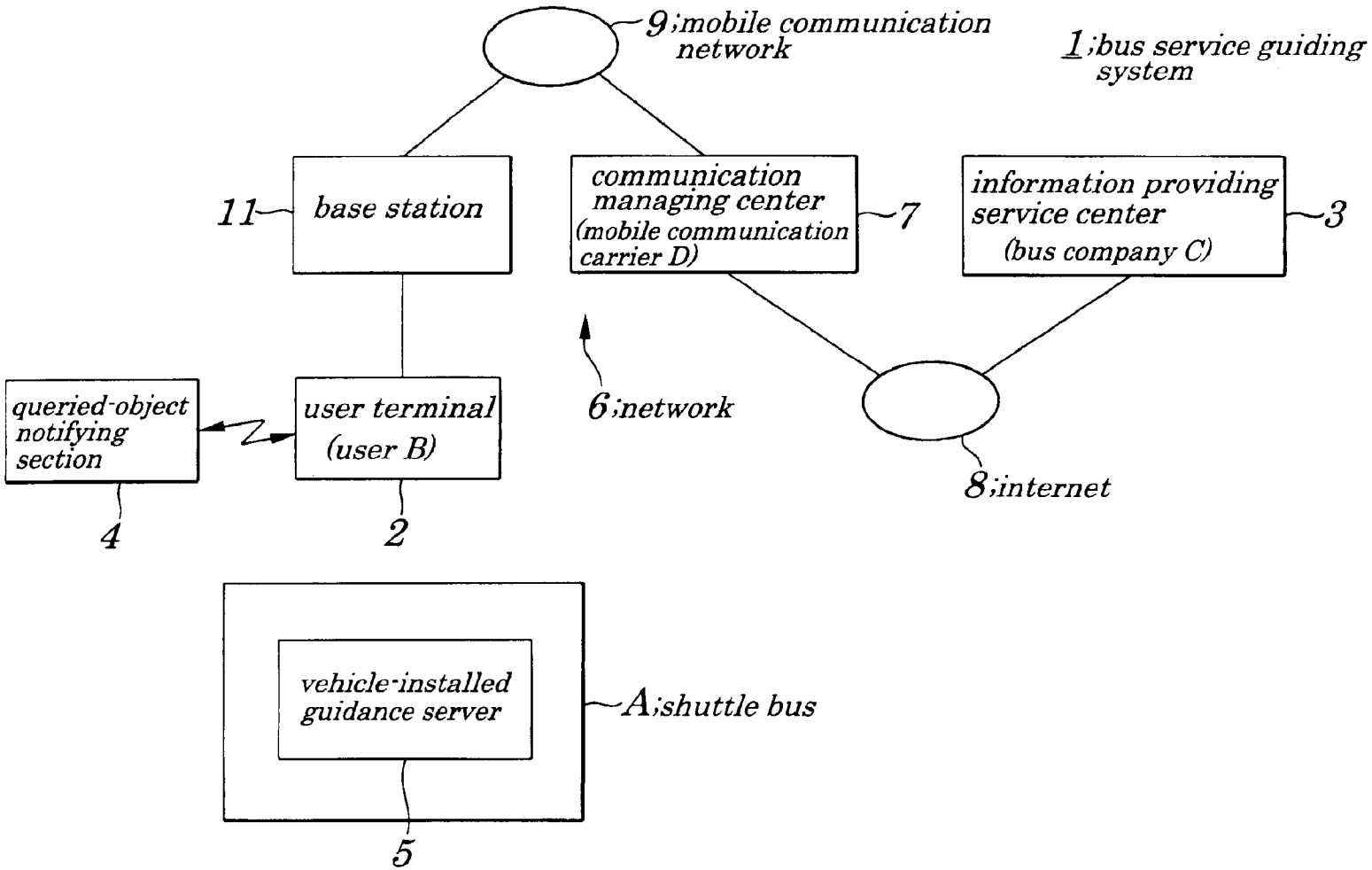
FIG. 1 is a schematic block diagram showing configurations of a bus service guiding system according to a first embodiment of the present invention.
Figure 2:
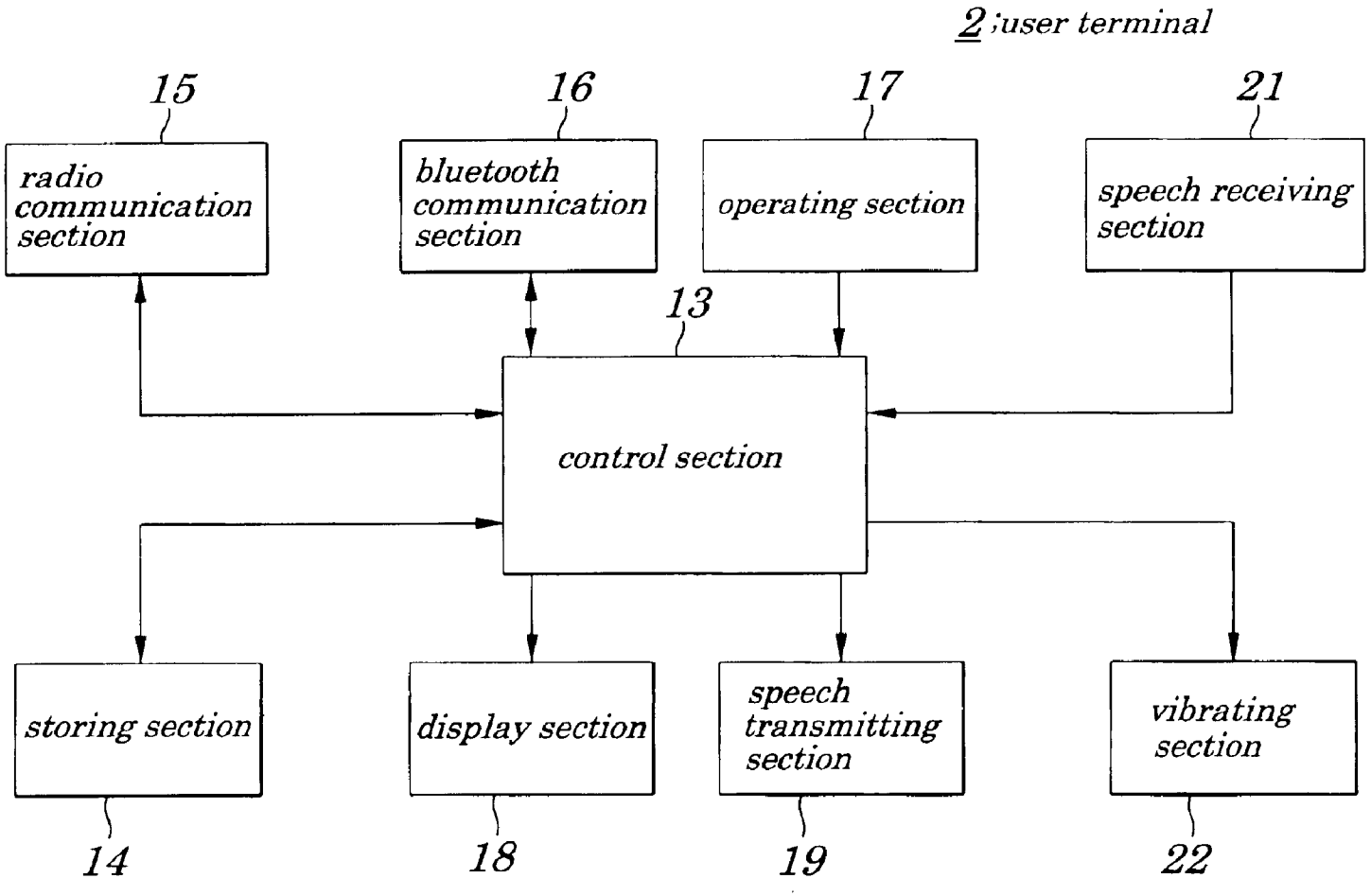
FIG. 2 is a schematic block diagram showing configurations of a user terminal in the bus service guiding system of the first embodiment of the present invention.
Figure 3:
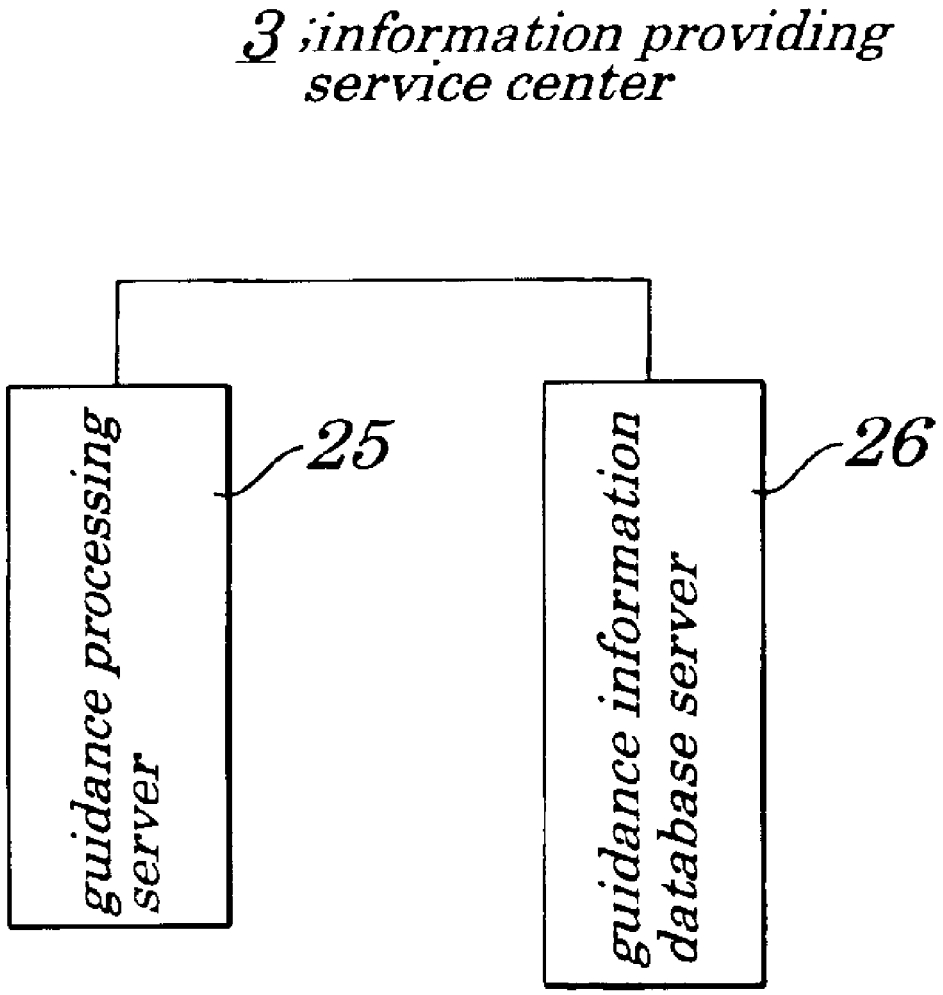
FIG. 3 is a schematic block diagram showing configurations of an information providing service center in the bus service guiding system of the first embodiment of the present invention.
Figure 4:
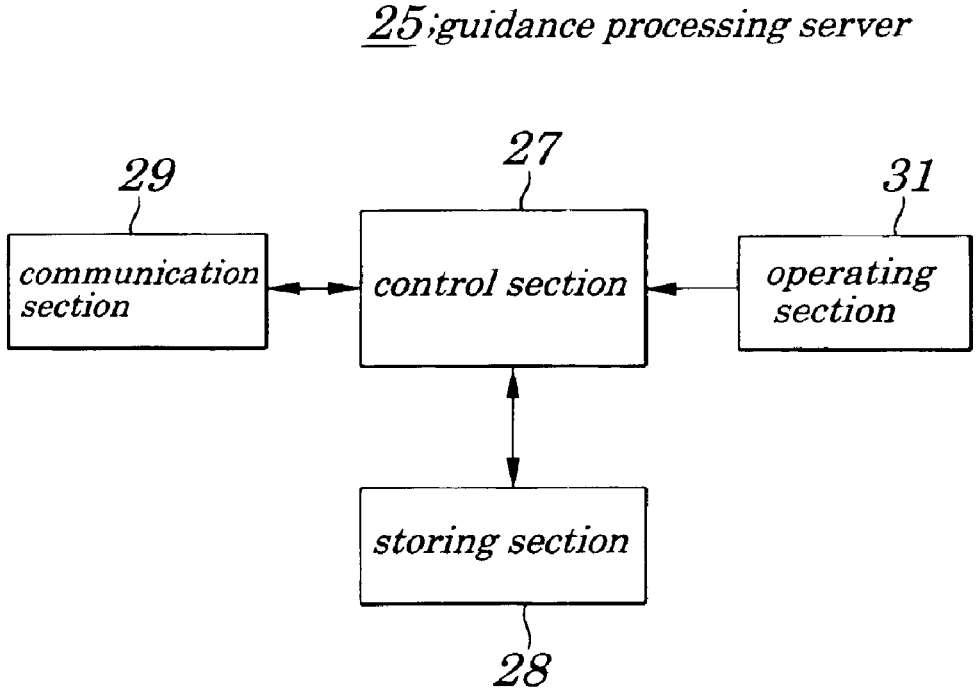
FIG. 4 is a schematic block diagram showing configurations of a guidance processing server installed in the information providing service center in the bus service guiding system of the first embodiment of the present invention.
Figure 5:
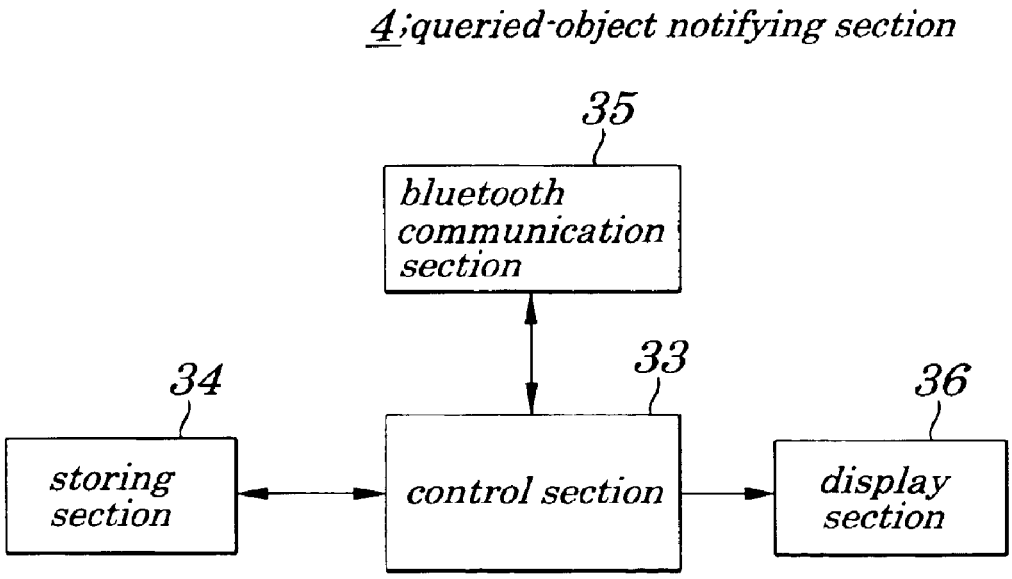
FIG. 5 is a schematic block diagram showing configurations of a queried-object notifying section in the bus service guiding system of the first embodiment of the present invention.
Figure 6:
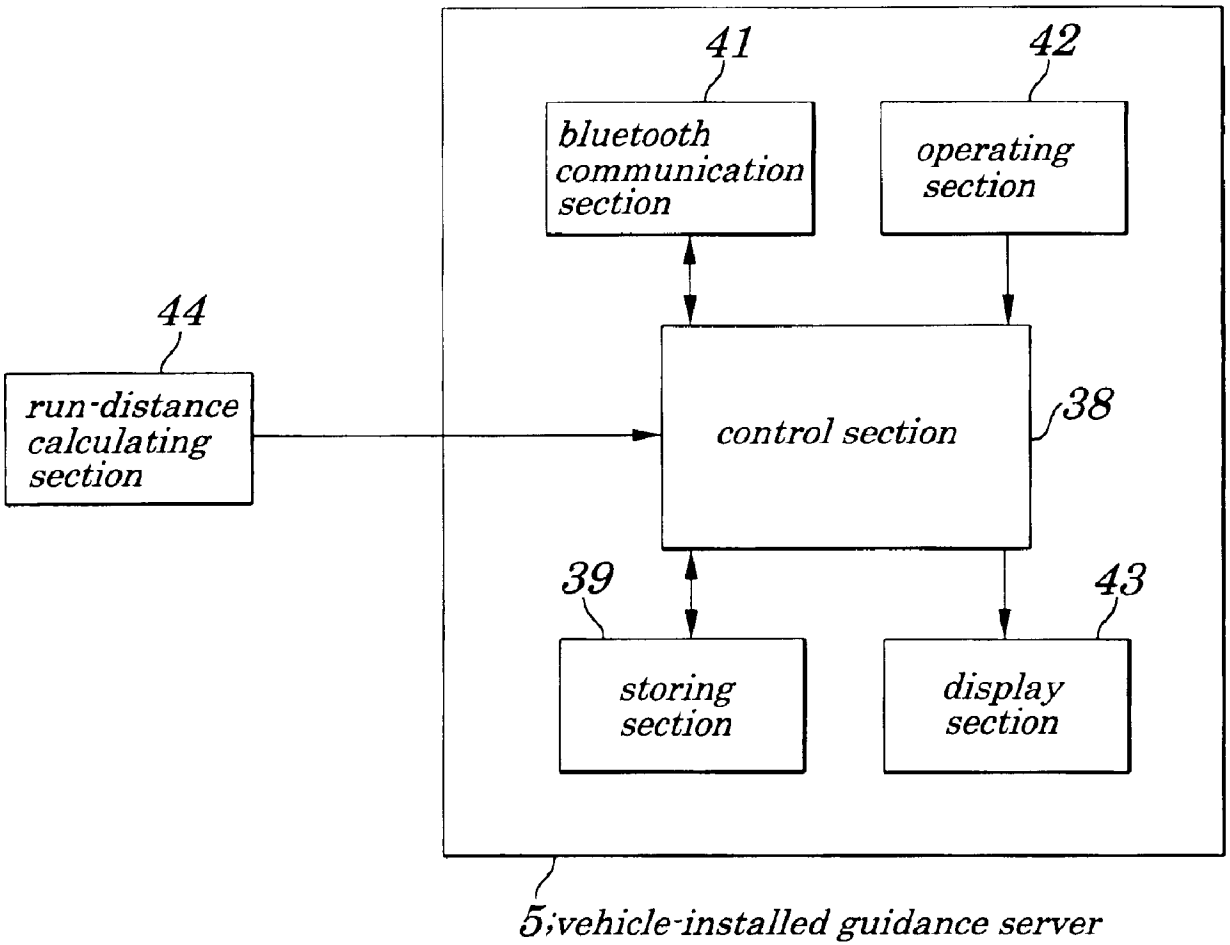
FIG. 6 is a schematic block diagram showing configurations of a vehicle-installed guidance server in the bus service guiding system of the first embodiment of the present invention.
Figure 7:
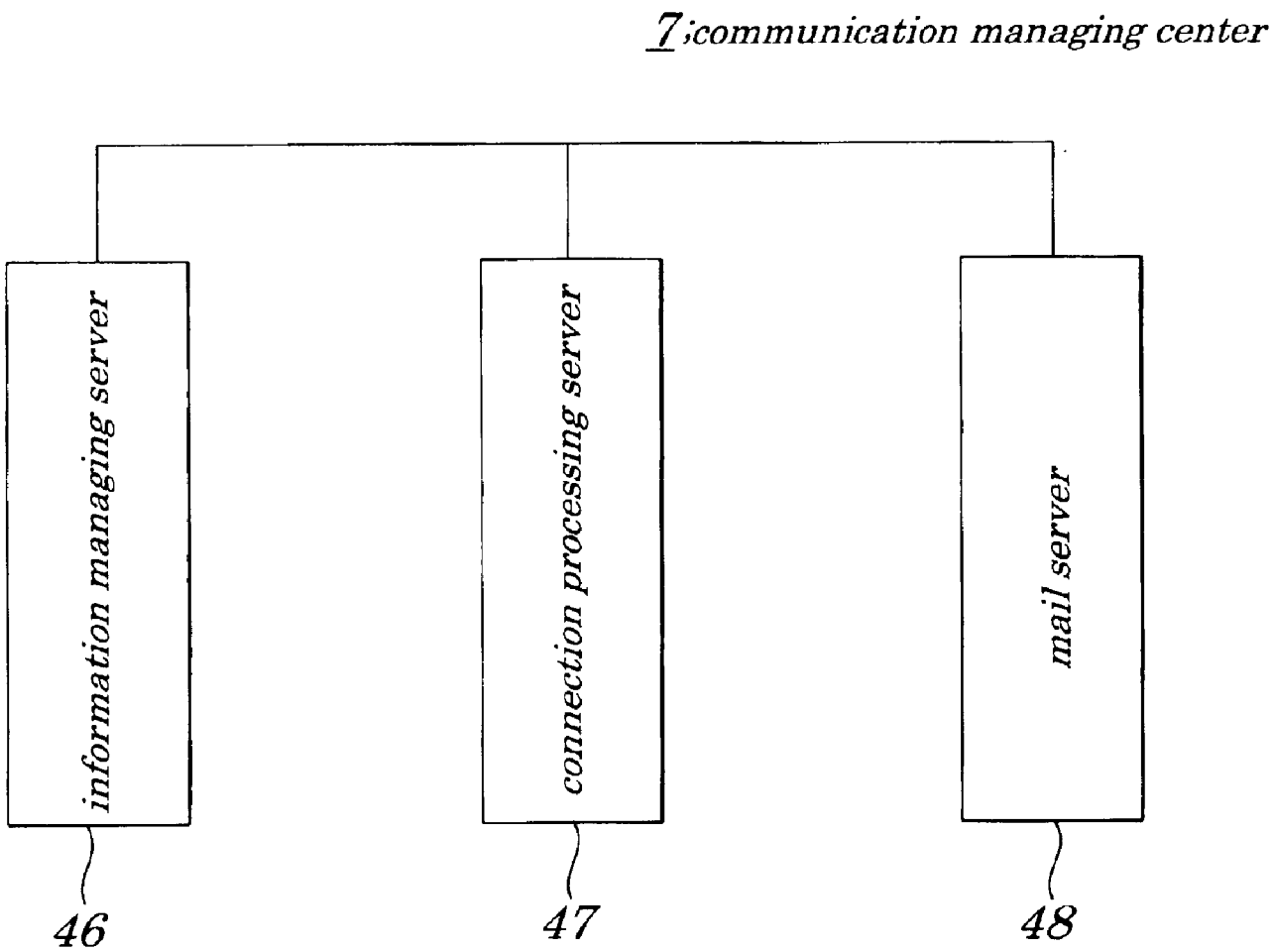
FIG. 7 is a schematic block diagram showing configurations of a communication managing center in the bus service guiding system of the first embodiment of the present invention.
Figure 8:
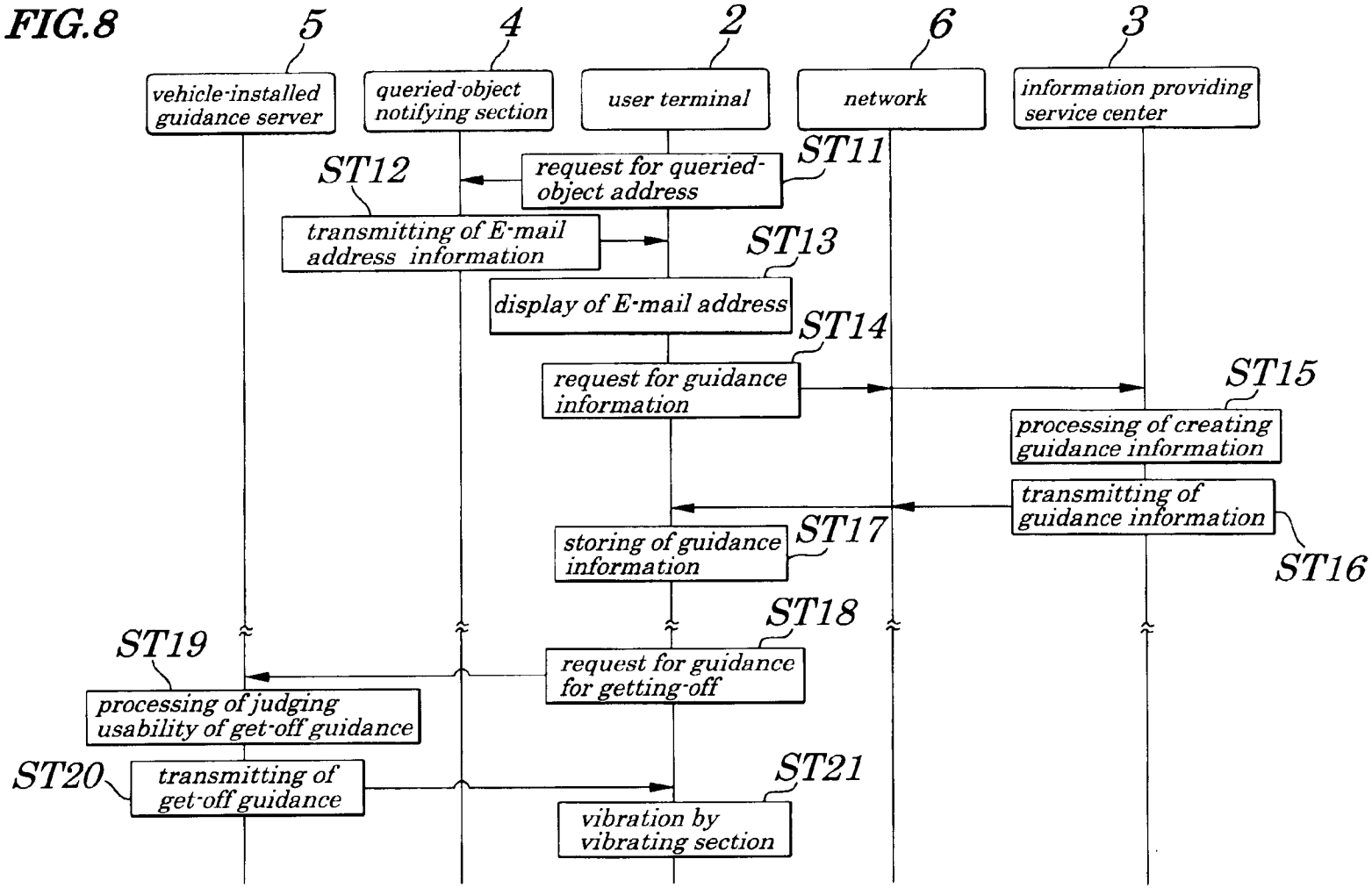
FIG. 8 is a process procedure diagram explaining operations of the bus service guiding system of the first embodiment of the present invention.
Figure 9A:
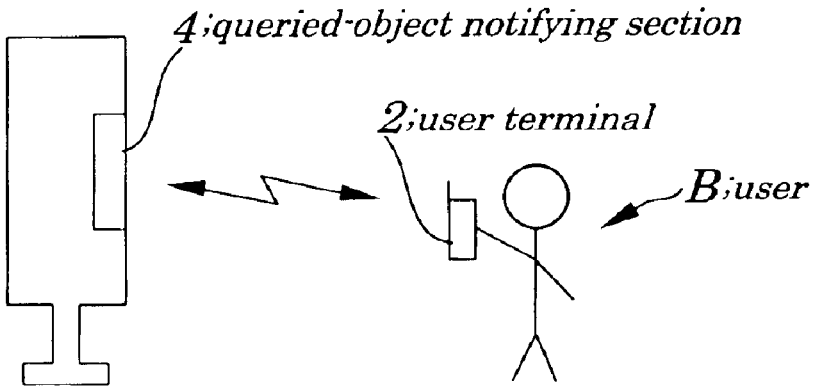
FIGS. 9A and 9B are diagrams explaining operations of the bus service guiding system of the first embodiment of the present invention.
Figure 9B:
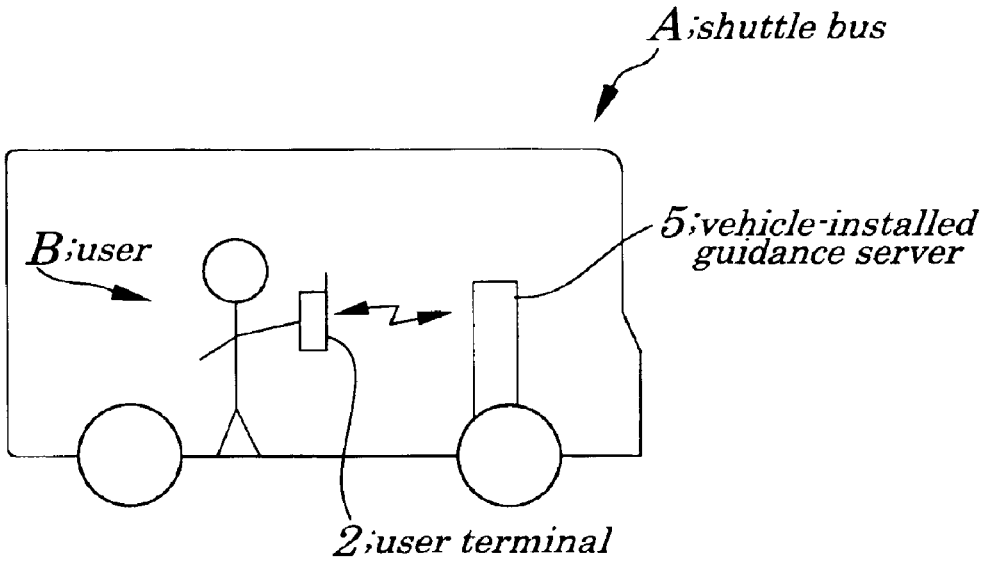

FIG. 1 is a schematic block diagram showing configurations of a bus service guiding system 1 according to a first embodiment of the present invention. FIG. 2 is a schematic block diagram showing configurations of a user terminal 2 of the bus service guiding system 1 of the first embodiment. FIG. 3 is a schematic block diagram showing configurations of an information providing service center 3 of the bus service guiding system 1 of the first embodiment. FIG. 4 is a schematic block diagram showing configurations of a guidance processing server 25 installed in the information providing service center 3 in the bus service guiding system 1 of the first embodiment. FIG. 5 is a schematic block diagram showing configurations of a queried-object notifying section 4 in the bus service guiding system 1 of the first embodiment. FIG. 6 is a schematic block diagram showing configurations of a vehicle-installed guidance server 5 in the bus service guiding system 1 of the first embodiment. FIG. 7 is a schematic block diagram showing configurations of a communication managing center 7 in the bus service guiding system 1 of the first embodiment. FIG. 8 is a process procedure diagram explaining operations of the bus service guiding system 1 of the first embodiment. FIGS. 9A and 9B are diagrams explaining operations of the bus service guiding system 1 of the first embodiment.

The bus service guiding system (transport vehicle service guiding system) 1 of the first embodiment, as shown in FIG. 1, includes a user terminal 2 to be used by a user B of a shuttle bus A being operated as a public transport vehicle, an information providing service center (guidance information providing center) 3 controlled by, for example, a bus company C and adapted to provide guidance information about the shuttle bus A in response to a request from the user terminal 2, a queried-object information section (queried-object notifying unit) 4 placed, for example, at a bus stop at a terminal and adapted to notify the user terminal 2 of an electric mail (e-mail) address or a URL (Uniform Resource Locator) as a queried-object of the information providing service center 3, a vehicle-installed guidance server (vehicle-installed communication unit) 5 installed within the shuttle bus A, and a network 6 to connect the user terminal 2 to the information providing service center 3. The network 6 is so constructed as to have a mobile communication network 9 that can be connected to the Internet 8 via a communication managing center 7 controlled by a mobile communication carrier D. In the embodiment, a request for guidance information from the user terminal 2 is transmitted toward the communication managing center 7 by way of a base station 11 nearest to the user terminal 2 and corresponding guidance information fed from the information providing service center 3 connected to the Internet 8 is fed to the user terminal 2 via the communication managing center 7. Moreover, the queried-object information section 4 and the vehicle-installed guidance server 5 are not connected to the network 6.

The user terminal 2 is a mobile terminal such as a portable cellular phone or a like being carried by a user B of a shuttle bus A to make a request for guidance information and has a function, in addition to its original speech function, of data communications by packet switching, of radio communications with communication devices being placed at comparatively near distances (for example, within about 10 m) by using Bluetooth technology (basic Specification of wireless personal area network; IEEE802.15), and of communication control to stop communications other than near-distance radio communications using the Bluetooth technology by specified operations of the user B. The user terminal 2, as shown in FIG. 2, chiefly includes a control section 13, a storing section 14, a radio communication section 15, a Bluetooth communication section 16, an operating section 17, a display section 18, a speech transmitting section 19, a speech receiving section 21, and a vibrating section 22.

The control section 13 is made up of a CPU (Central Processing Unit) or a like, executes various processing programs such as a communication control program, a browser serving as a program used to browse a home page, a mailer serving as a program used to create, transmit and receive an e-mail, or a like all being stored in the storing section 14 and controls each component making up a main body of the user terminal 2. The control section 13, according to programs being stored in the storing section 14, in addition to ordinary processing to serve as a portable cellular phone, performs processing of receiving guidance information about the shuttle bus A by making access to the information providing service center 3 via the network 6.

The control section 13, for example, when a Bluetooth transmitting key (described later) is pressed down in a vicinity of the queried-object notifying section 4 in a state where a mailer has been started and an e-mail address inputting screen has been displayed on the display section 18, exerts control so as to have the Bluetooth communication section 16 transmit a queried-object address requesting signal used to make an inquiry about an e-mail address to be addressed to the information providing service center 3 to the queried-object notifying section 4 and further, when the e-mail address of the information providing service center 3 is received from the queried-object notifying section 4 through the Bluetooth communication section 16, has the display section 18 display the received e-mail address. Also, the control section 13, when the Bluetooth key is pressed down, for example, within the shuttle bus A, in a state where guidance information fed from the information providing service center 3 is displayed on the display section 18, exerts control so as to have the Bluetooth communication section 16 transmit the received guidance information and a get-off guidance requesting signal to request for get-off guidance based on the guidance information to the vehicle-installed guidance server 5 and, when the get-off guidance requesting signal is received from the vehicle-installed guidance server 5 via the Bluetooth communication section 16, exerts control to have the vibrating section 22 vibrate to prompt the user B to prepare for getting out of the shuttle bus A.

The storing section 14 is made up of semiconductor memories such as a ROM (Read Only Memory), RAM (Random Access Memory), or a like and stores various processing programs for a browser, a mailer, or a like to be executed by the control section 13 and various pieces of information including received information and has various types of registers or flags to be used when the control section 13 executes the programs. The radio communication section 15 modulates a voice and/or data and transmits it as a radio wave through an antenna (not shown) to a nearest base station 11 making up the network 6 and receives a radio wave transmitted from the base station 11 through the antenna and demodulates it to produce voice and/or data. The Bluetooth communication section 16 has an RF (Radio Frequency) chip to transmit and receive a radio wave with a band of 2.45 GHz through the antenna and a base band chip and is used to receive queried-object address information, get-off guidance information, or a like. Here, a radio wave transmitting distance is about 10 m and communications between the user terminal 2 and queried-object notifying section 4 and between the user terminal 2 and vehicle-installed guidance server 5 are carried out at near distances of about 10 m or less.

The operating section 17 is placed at a front of a case of the user terminal 2, which has the Bluetooth transmitting key used to carry out communications using the Bluetooth technology, a communication limiting mode key used to switch communications to a communication limiting mode in which communications other than near-distance communications using the Bluetooth technology is stopped, a mail mode selecting key used to create, transmit, and receive an e-mail, a speech mode selecting key used to carry out voice speech, a browser mode selecting key used to start a browser and to browse a home page, a clearing key used to switch from a photographing mode or a like to a standby mode in which a standby screen is displayed and operations and arrival of signals are waited for, a power supply key, a ten-key pad used to input numerals or a like, a cursor key used to move a cursor on a display screen displayed on the display section 18 in up-and-down and left-and-right directions, or a like. The display section 18 is made up of a liquid crystal display or a like and displays guidance information, message, or a like having received from, for example, the information providing service center 3, or a like. The speech transmitting section 19 has a microphone (not shown). The speech receiving section 21 has a speaker (not shown). The vibrating section 22 generates vibration which is used to attract the attention of the user B at time of getting off and to give notification of receipt of a signal.

The information providing service center 3, as shown in FIG. 3, has a guidance processing server 25 to automatically feed back guidance information in response to a guidance information request fed from the user terminal 2 and a guidance information database server 26. The guidance processing server 25, as shown in FIG. 4, includes a control section 27 to control each component according to specified control programs, a storing section 28 to store various programs including guidance processing program or a like, or data, a communication section 29 to carry out data communications according to specified protocols, and an operating section 31. The control section 27 is made up of a CPU or a like, executes various programs being stored in the storing section 28, controls each component making up the guidance processing server 25 and performs guidance processing or a like. The storing section 28 is made up of a ROM, a RAM, an FDD (Flexible Disk Driver) having an FD (Flexible Disk), a HDD (Hard Disk Driver) having a HD (Hard Disk), a CD-ROM (Compact Disk Read Only Memory) driver having a CD-ROM, or a like.

In the guidance processing program, procedures are written by which, when a guiding information request and destination information made up of, for example, a plurality of keywords are received from the user terminal 2 via the communication managing center 7, access is made to the guidance information database server 26 to search for a most suitable get-off bus stop out of bus stops being associated with the keywords and further, a name of the get-off bus stop, destination names of all shuttle buses which stop at the get-off bus stop, departure time of shuttle buses at a bus stop where the user B exists at the present time, operating routes (names of all bus stops at which a shuttle bus stops), a distance from a bus stop at which the user B gets on to a bus stop at which the user B gets off, time required for running between the bus stop at which the user B gets on and the bus stop at which the user B gets off, and time required for walking between the bus stop at which the user B gets off and the destinations is searched for to create guiding information including results from the search and to transmit the guiding information to the user terminal 2.

Moreover, in this guidance processing program, a procedure is written by which map information is added to the guiding information, when necessary, to be transmitted. Furthermore, a procedure is also written by which, even if a specified proper noun is not contained in keywords, when a word such as a "dentistry", "Sunday home call", or "acceptance of an emergency case" is contained, an associated specified dental clinic is selected and a nearest bus stop is searched for and names of destinations of all shuttle buses that stop at the bus stop, departure time at the bus stop where the user B exists at the present time, operating routes (names of all bus stops where the shuttle bus stops), a distance from a bus stop at which the user B gets on to a bus stop at which the user B gets off, time required for running between the bus stop at which the user B gets on and the bus stop at which the user B gets off, and walking time required, after getting out of the shuttle bus A, for the user B to reach a destination are searched for to create guidance information containing results from the search and to transmit the guidance information to the user terminal 2.

The guidance information database server 26 has same hardware configurations as the above guidance processing server 25, which includes a control section to control each component making up the guidance information database server 26 according to specified control programs, a storing section to store various programs or data, a communication section to carry out data communications according to a specified protocol, and an operating section. In a storing section (not shown) of the guidance information database server 26, information about shuttle buses being associated with keywords is stored in a form of a database. The information about shuttle buses contains names of bus stops of the shuttle buses on all routes operated by a bus company C, destinations of the shuttle buses on all routes that stop at each of the bus stops, time table information, operating routes, a location of each of the bus stops, a name of a building nearest to each of the bus stops, a name of a manager (or an owner name or resident name) of the building, a park, or a like. Moreover, when the above building is a commercial or public facility, or a medical institution or a like, information about a type of business, operating hour, or a like is added as additional information. The map information is stored in a form of image data.

The queried-object notifying section 4 is attached to, for example, a guidance board at a bus stop for the shuttle bus A and chiefly includes, as shown in FIG. 5, a control section 33, a storing section 34, a Bluetooth communication section 35, and a display section 36. The control section 33 is made up of a CPU or a like and executes various processing programs such as a communication control program or a like being stored in the storing section 34 and controls each component of a main body of the queried-object notifying section 4. The storing section 34 is made up of semiconductor memories such as a ROM, RAM, or a like and stores various processing programs such as the communication control program or a like to be executed by the control section 33 and various pieces of information such as electronic mail address information of the information providing service center 3 and/or received information or a like and has various types of registers and/or flags to be used when the control section 33 executes programs. The Bluetooth communication section 35 has approximately the same configurations as the Bluetooth communication section 16 in the user terminal 2 and, when a queried-object address requesting signal is received from the user terminal 2, transmits e-mail address information of the information providing service center 3 to the user terminal 2.

The vehicle-installed guidance server 5 is installed on the shuttle bus A and has, as shown in FIG. 6, a control section 38, a storing section 39, a Bluetooth communication section 41, an operating section 42, and a display section 43. Moreover, to the vehicle-installed guidance server 5 is connected a operated-distance calculating section 44 mounted on the shuttle bus A. The control section 38 is made up of a CPU or a like and executes various processing programs such as a get-off guidance program, communication control program, or a like being stored in the storing section 39 and controls each component making up a main body of the vehicle-installed guidance server 5.

The storing section 39 is made up of semiconductor memories such as a ROM, RAM, or a like and stores the various processing programs such as the communication control program or a like to be executed by the control section 38 and various pieces of information such as received information or a like and has various types of registers and/or flags to be used when the control section 33 executes the programs. In the get-off guidance program, a procedure is written by which the Bluetooth communication section 41 is controlled based on guidance information fed from the user terminal 2 and on run-distance information fed from the operated-distance calculating section 44 so that get-off guidance information is transmitted, with specified timing, to the user terminal 2. The Bluetooth communication section 41 has approximately the same configurations as the Bluetooth communication section 16 in the user terminal 2 and receives guidance information from the user terminal 2 and transmits, by control of the control section 38, get-off guidance information to the user terminal 2. The operating section 42 is made up of a ten-key pad and/or function keys, or a like. The display section 43 is made up of a liquid crystal display or a like.

The communication managing center 7 (shown in FIG. 7) has an information managing server 46 to manage customer information or a like, a connection processing server 47 to connect the mobile communication network 9 to, for example, the Internet 8, and a mail server 48 to store an e-mail transmitted from, for example, the user terminal 2 and/or an e-mail having been transmitted to the user terminal 2. The information managing server 46 (also, connection processing server 47, and mail server 48) has approximately the same hardware configurations as the guidance processing server 25 described above and includes a control section to control each component making up the information managing server 46 according to a specified control program, a storing section to store various programs and/or data, a communication section to carry out data communications according to a specified protocol, and an operating section. In a storing section of the information managing server 46, information about a present location of the user terminal 2, subscriber number, charging information, or a like are stored with the information being promptly updated by a transaction processing in an online service.

Next, operations of the bus service guiding system 1 having the configurations described above are described by referring to FIG. 8 and FIGS. 9A and 9B.

Now, let it be assumed that a user B has agreed to provide information about a position of the user B to the information providing service center 3 managed by the bus company C and the mobile communication carrier D has signed a contract to provide information about a location of the user terminal 2 possessed by the user B, in response to a request from the information providing service center 3, to the information providing service center 3. A user terminal identification signal is transmitted, by a specified period, from the user terminal 2 during power is ON to a nearest base station and then, through a higher-rank office of the base station, to the communication managing center 7. In a storing section of the information managing server 46 in the communication managing center 7, user terminal location information corresponding to a telephone number assigned to the user terminal 2 is stored with the information being ordinarily updated.

Again, let it be assumed that the user B is thinking to use a shuttle bus A to go to an X sports stadium and is going toward a bus stop at a terminal. The user B comes near to a place within a distance of about 10 m from a guidance board at the bus stop. Next, the user B, when wishing to obtain necessary guidance information from the information providing service center 3 by using an e-mail, operates the user terminal 2 and starts a mailer. The mailer is started by operations of the user B and the control section 13 displays an e-mail address input screen on the display section 18. Here, the user B, as shown in FIG. 9A, presses down a Bluetooth transmitting key with the user terminal 2 being directed toward the queried-object notifying section 4. When the Bluetooth transmitting key is pressed down, the control section 13 has the Bluetooth communication section 16 to transmit a queried-object address requesting signal used to make an inquiry about an e-mail address to be addressed to the information providing service center 3 to the queried-object notifying section 4 (Step ST11 in FIG. 8).

In the queried-object notifying section 4, when a queried-object address requesting signal is received, the control section 33 reads an e-mail address information of the information providing service center 3 from the storing section 34 and transmits the read information to the user terminal 2 (Step ST12). In the user terminal 2, when an e-mail address of the information providing service center 3 is received via the Bluetooth communication section 16, the control section 13 makes this e-mail address be displayed on an address column in the display section 18 (Step ST13). Next, the user B, in order to obtain information about the shuttle bus A passing through a bus stop nearest to a southern gate of the X sports stadium, inputs words "X sports stadium" and "southern gate" as keywords. By this, the control section 13 makes these keywords be displayed on a text column in the display section 18.

Next, when a transmitting key (not shown) displayed on a screen of the display section 18 is selected by operations of the user B, the control section 13 transmits guidance requesting information and destination information including keywords to the information providing service center 3 (Step ST14). The guidance requesting information and destination information are stored, on a temporary basis, in a storing section in the mail server 48 in the communication managing center 7 and then is transmitted to the information providing service center 3. In the information providing service center 3, when the guidance requesting information and destination information made up of, for example, a plurality of keywords are received via the communication managing center 7, processing of creating guidance information is started (Step ST15). The guidance processing server 25 first makes a request asking the communication managing center 7 to provide information about a location of the user terminal 2, receives the information about the location of the user terminal 2 from the information managing server 46, then identifies a bus stop nearest to the present position of the user B and stores it as a bus stop at which the user B has to get on in the storing section 28.

Next, in the guidance processing server 25, the control section 27 makes access to the guidance information database server 26 to search for a most suitable get-off bus stop out of bus stops being associated with keywords contained in the destination information and creates guidance information by retrieving destination names of all shuttle buses stopping at the most suitable bus stop, departure time of the shuttle buses departing from the get-on bus stops out of the bus stops being associated with keywords contained in the destination information within a time period from present time to designated time, and operating routes (names of all bus stops at which the shuttle bus A stops) and by calculating a distance from a bus stop at which the user B gets on to a bus stop at which the user B gets off, time required for running between the bus stop at which the user B gets on and the bus stop at which the user B gets off, and time required for walking between the bus stop at which the user B gets off and the destination. If no corresponding information cannot be searched for, a message containing a result from the search is created as guidance information.

Next, the guidance processing server 25 transmits the created guidance information to the user terminal 2 or replies to the user terminal 2 (Step ST16). The guidance information is stored, on a temporary basis, in a storing section of the mail server 48 in the communication managing center 7 and is transmitted to the user terminal 2. In the user terminal 2, when guidance information is received from the information providing service center 3 through the communication managing center 7, the control section 13 makes the guidance information fed from the information providing service center 3 be stored in the storing section 14 (Step ST17) and, at a same time, be displayed in the display section 18. In the display section 18, for example, a name of a get-off bus stop, a destination name of the shuttle bus A that stops at the bus stop, departure time of the shuttle bus A at a get-on bus stop nearest to a present position of the user B of the shuttle bus A, operating routes (names of all bus stops at which the shuttle bus A stops), a distance from the bus stop at which the user B gets on to a bus stop at which the user B gets off, time required for running between the bus stop at which the user B gets on and the bus stop at which the user B gets off, and time required for walking between the bus stop at which the user B gets off and the destination (in the example, the southern gate of the X sports stadium). The user B checks the guidance information and, after having put the user terminal 2 into a communication limiting mode by pressing down the communication limiting mode key (not shown), gets on the specified shuttle bus A.

When the user B gets on the shuttle bus A, as shown in FIG. 9B, the user B presses down the Bluetooth transmitting key with the user terminal 2 being directed toward the vehicle-installed guidance server 5. The control section 13, when the Bluetooth transmitting key is pressed down by the user B, has the Bluetooth communication section 16 transmit the received guidance information and a get-off guidance requesting signal that makes a request asking guidance for getting off based on the guidance information to the vehicle-installed guidance server 5 (Step ST18). In the vehicle-installed guidance server 5, when guidance information and the get-off guidance requesting signal are received from the user terminal 2, the control section 38 makes the guidance information be stored, on a temporary basis, in the storing section 39. Next, the control section 38 performs processing of judging whether the get-off guidance is proper or not, based on run-distance information to be obtained from the run-distance calculating section 44 and a distance from a bus stop at which the user B gets on to a bus stop at which the user B gets off (Step ST19) and controls the Bluetooth communication section 41 with specified timing and transmits the get-off guidance information to the user terminal 2 (Step ST20). The control section 38 compares a distance from a get-on bus stop to a get-off bus stop with a run-distance from the get-on bus stop and, when the shuttle bus approaches a place within a specified distance (for example, 300 m) from a get-off bus stop, makes get-off guidance information be transmitted to the user terminal 2.

In the user terminal 2, when the get-off guidance information is received through the Bluetooth communication section 16 from the vehicle-installed guidance server 5, the control section 13 controls the vibrating section 22 so as to vibrate (Step ST21) to prompt the user B to prepare for getting out of the shuttle bus A. This can prevent the user B from riding past a desired bus stop and enables the user B to get out of the target bus stop. Moreover, in guidance information creating processing to be performed by the guidance processing server 25, even if a specified proper noun is not contained in keywords, when a word such as a "dentistry", "Sunday home call", or "acceptance of an emergency case" is contained, the control section 27 making up the guidance processing server 25 makes access to the guidance information database server 26, searches for an associated specified dental clinic, selects a most suitable get-off bus stop and creates guidance information by retrieving destination names of all shuttle buses that stop at the most suitable bus stop, departure time of the shuttle buses departing from the get-on bus stops where the user B exists, operating routes (names of all bus stops at which the shuttle bus A stops) and by calculating a distance from a bus stop at which the user B gets on to a bus stop at which the user B gets off, time required for running between the bus stop at which the user B gets on and the bus stop at which the user B gets off, and time required for walking between the bus stop at which the user B gets off and the destination and then transmits the above information to the user terminal 2.

Thus, as described above, according to the bus service guiding system of the first embodiment of the present invention, the user B, by receiving, before getting on the shuttle bus A, guidance information containing a shuttle bus destination name corresponding to information about destination, departure time of the shuttle buses from the information providing service center 3, can certainly get on the shuttle bus A running by way of a target place and, when the shuttle bus A approaches a get-off bus stop, by receiving get-off guidance information from the vehicle—installed guidance server 5, can certainly get out of the shuttle bus A at a target bus stop without riding past the target bus stop, for example, even in an unfamiliar area. Moreover, in the shuttle bus A, the user terminal 2 is so constructed as to receive get-off guidance information by carrying out comparatively near-distance communications with the vehicle-installed guidance server 5 using the Bluetooth technology and, since a radio wave being so intense that, for example, some of medical apparatuses are adversely affected is neither transmitted nor received, the bus service guiding system does not do harm to a user of some of medical apparatuses being used in the same shuttle bus A.

Moreover, since transmission and/or receipt of information between the user terminal 2 and information providing service center 3 can be performed by using, for example, an e-mail, a communication cost per one operation is low (for example, less than 10 yen), which enables economical burdens on the user B to be lightened when compared with a case where conventional technology is used. Also, since guidance information fed from the information providing service center 3 can be reused by storing the information in the storing section 14, economical burdens on the user B can be lightened and a load of inputting work by the user B can be reduced. Since guidance information can be obtained rapidly, whenever necessary, without delay, from the information providing service center 3, proper measurements can be taken in case of an emergency. Since an existing system can be used to carry out transmission and/or receipt of an e-mail, the bus service guiding system 1 can be constructed at comparatively low costs.

Even when not only a name of a get-off bus stop but also an exact name of a facility existing at a target place or a name of the target place is unknown, by transmitting an associated keyword as target place information to the information providing service center 3, guidance information including a name of a most suitable nearest get-off bus stop can be acquired. Also, when access is made from the user terminal 2 to the information providing service center 3, since an e-mail of the information providing service center 3 can be automatically received from the queried-object notifying section 4, it is possible to simply and rapidly make a request asking the information providing service center 3 to provide guidance information.

Moreover, the guidance processing server 25 is so constructed as to receive information about a location of the user terminal 2 from the communication managing center 7 and to identify a bus stop nearest to a present position of the user B, the user B can more simply and rapidly make a request asking the information providing service center 3 to provide guidance information without a need for inputting the present position of the user B. Also, according to the bus service guiding system of the embodiment of the present invention, not only in the case of going to a specified target place but also in the case of going to, for example, a dental clinic for treatment on a day off, by having the information providing service center 3 search for a most suitable shuttle bus or a bus stop, the user B can achieve a specified purpose. Since the control section in the vehicle-installed server 5 judges timing with which get-off guidance information is transmitted to the user terminal 2 based on a run-distance of the shuttle bus A, the bus service guiding system can transmit get-off guidance information with exact timing and can be also constructed at low costs.

Second Embodiment

Figure 10:
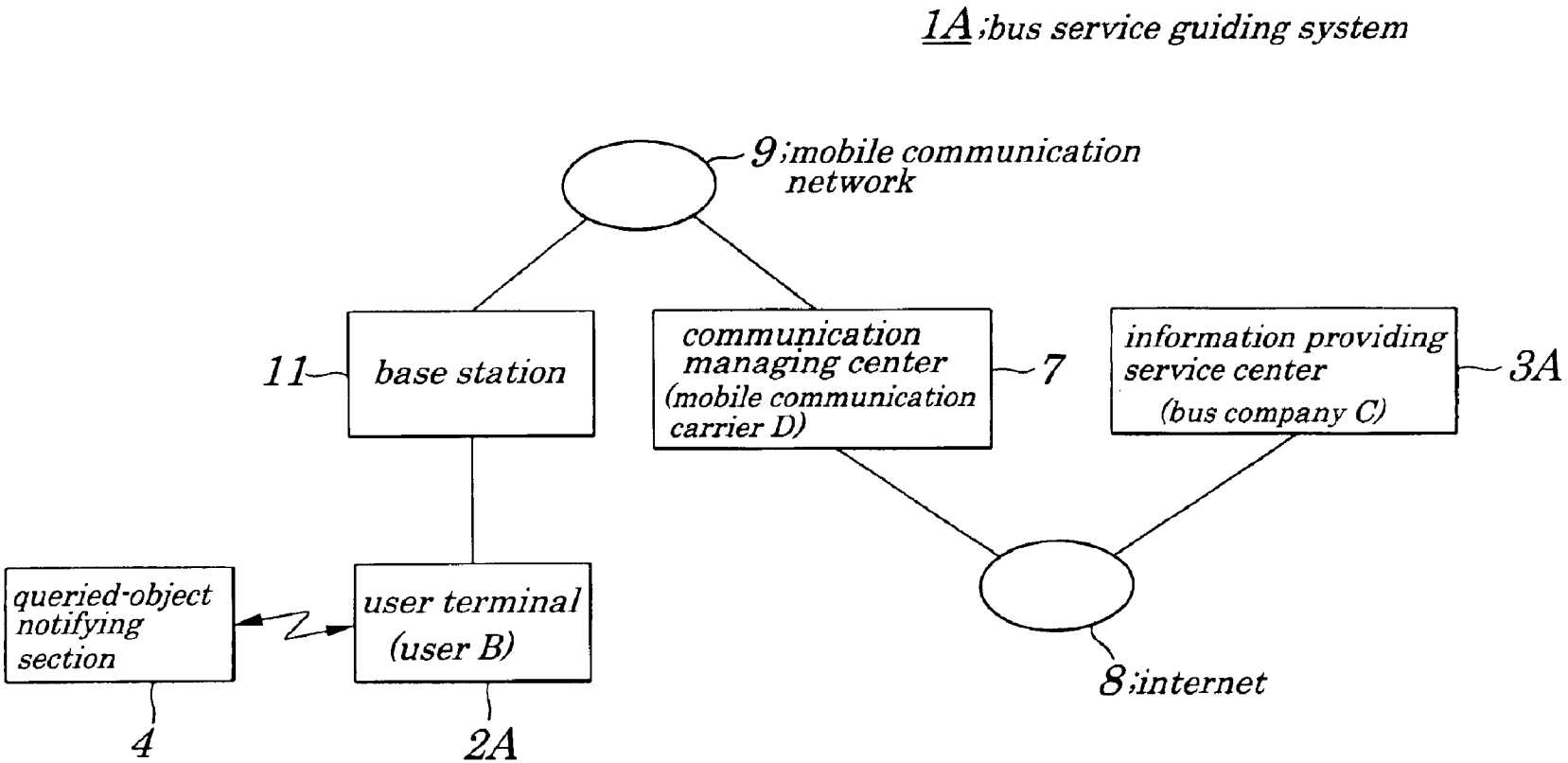
FIG. 10 is a schematic block diagram showing configurations of a bus service guiding system according to a second embodiment of the present invention.
Figure 11:
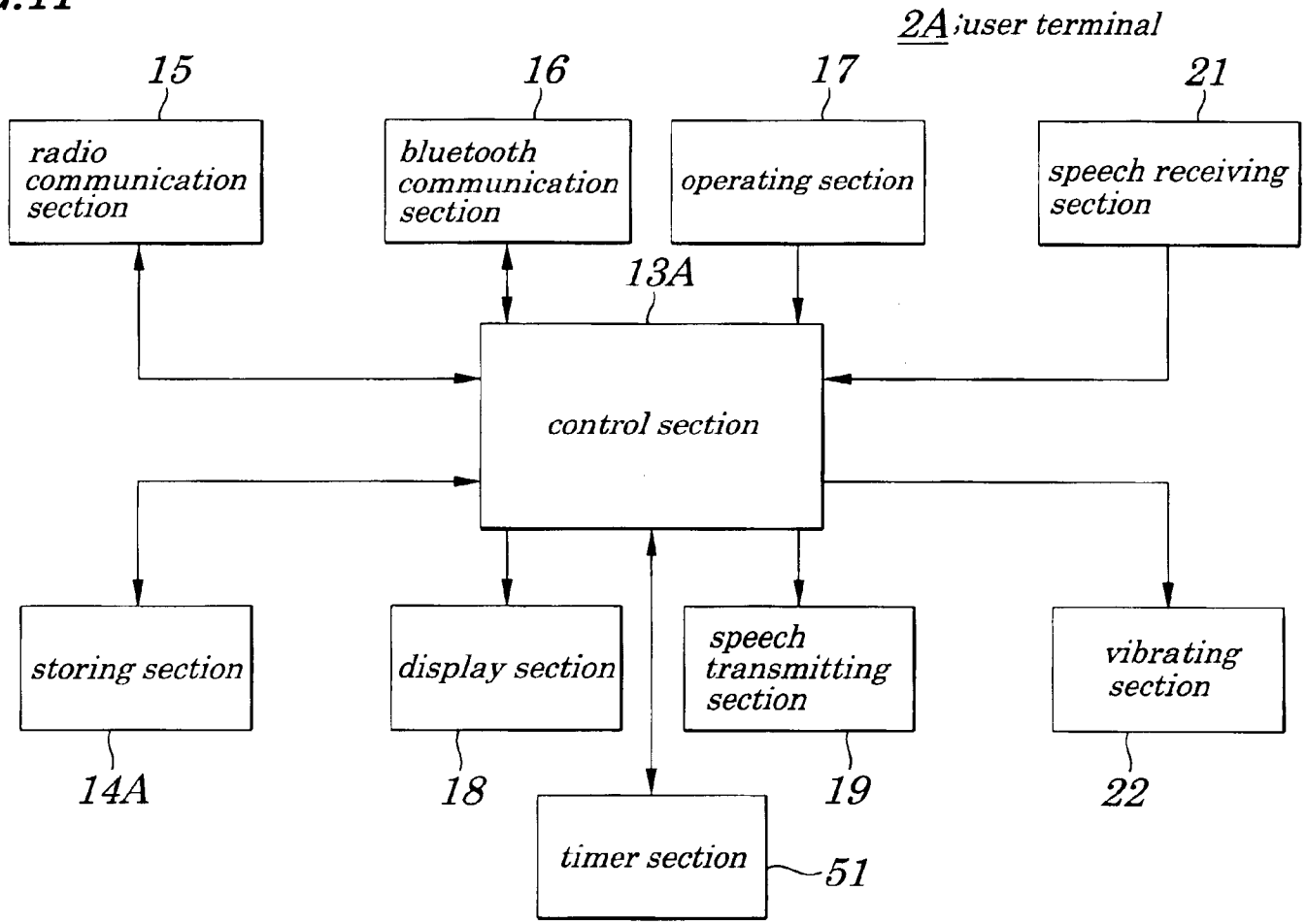
FIG. 11 is a schematic block diagram showing configurations of a user terminal in the bus service guiding system of the second embodiment of the present invention.

FIG. 10 is a schematic block diagram showing configurations of a bus service guiding system 1A according to a second embodiment of the present invention. FIG. 11 is a schematic block diagram showing configurations of a user terminal in the bus service guiding system 1A of the second embodiment.

Configurations of the bus service guiding system 1A of the second embodiment shown in FIG. 10 differ from those of the first embodiment in that a control section of a user terminal 2A determines timing for transmitting get-off guidance information based on time required for running from a get-on bus stop (in the first embodiment, the timing for transmitting get-off guidance information is determined based on a run-distance from the get-on bus stop) and a vehicle-installed guidance server is not employed. Its configurations other than described above are the same as those of the first embodiment and their descriptions are omitted accordingly.

The bus service guiding system (transport vehicle service guiding system) 1A of the second embodiment, as shown in FIG. 10, includes the user terminal 2A to be used by a user B of a shuttle bus A, an information providing service center (guidance information providing center) 3A to provide guidance information about the shuttle bus A in response to a request from the user terminal 2A, a queried-object notifying section (queried-object notifying unit) 4 to notify the user terminal 2A of an e-mail address or URL of the information providing service center 3A, and a base station 11, a mobile communication network 9, a communication managing center 7 and an information providing service center 3A to connect the user terminal 2A to the information providing service center 3A.

The user terminal 2A, as shown in FIG. 11, chiefly includes a control section 13A, a storing section 14A, a radio communication section 15, a Bluetooth communication section 16, an operating section 17, a display section 18, a speech transmitting section 19, a speech receiving section 21, a vibrating section 22, and a timer section 51 to measure a length of time.

In the embodiment, the control section 13A executes various processing programs such as a get-off guidance processing program being stored in the storing section 14A and controls each component making up a main body of the user terminal 2A. In the get-off guidance program, a procedure is written by which judgement is made as to whether or not get-off guidance is proper based on guidance information fed from the information providing service center 3A and on information about measured time obtained from the timer section 51 and the vibrating section 22 is controlled with specified timing so as to vibrate to prompt the user B to prepare for getting out of the shuttle bus A. This can prevent the user B from riding past a desired bus stop and enables the user B to get out of the target bus stop. Moreover, the guidance information created and transmitted by the information providing service center 3A contains a time table which has been amended based on information about a traffic jam or a like. Moreover, the timer section 51 shows present time and transmits a notification signal to the control section 13A at a scheduled notification time.

In the embodiment, the control section 13A makes a candidate for the shuttle bus A for the user B to get on as one of choices contained in the guidance information received from the information providing service center 3A be displayed on the display section 18 and, when a specified shuttle bus A is selected by selecting operations of the user B, gives a time occurring a specified period of time before a corresponding arrival time of the shuttle bus A (for example, 30 minutes before the arrival time) as notification time to the timer section 51 and then makes the vibrating section 22 vibrate when receiving the notification signal from the timer section 51. Moreover, the above departure time and arrival time are determined based on the amended time table.

Thus, according to the bus service guiding system 1A of the second embodiment, same effects as obtained in the first embodiment can be achieved. In addition, according to the second embodiment, since a vehicle-installed guidance server is not employed, the bus service guiding system 1A can be constructed at further low costs.

It is apparent that the present invention is not limited to the above embodiments but may be changed and modified without departing from the scope and spirit of the invention. For example, in the above embodiment, the shuttle bus is used as the transport vehicle, however, not only to a shuttle bus but also a train including a streetcar as a transport vehicle may be employed. Moreover, in order to connect the information providing service center 3 to the communication managing center 7, a dedicated radio communication network, which does not belong to the Internet, may be used. Instead of the near-distant radio communications using the Bluetooth technology, an infrared communication may be used. In this case, a communication distance between the user terminal 2 and queried-object notifying section 4 and between the user terminal 2 and vehicle-installed guidance server 5 may be set so as to be several meters or less (for example, 8 m or less). Also, a plurality of the Bluetooth communication sections 41 in the vehicle-installed guidance server 5 may be mounted, for example, one Bluetooth communication section 41 may be installed in every seat. This can be applied to a case where infrared communications are carried out. This enables information to be transmitted and received in a smooth and reliable manner in the bus service guiding system. Also, in the queried-object notifying section 4, notification of an e-mail address or a like may be made by displaying and inputting of the e-mail address may be performed by a user B. This enables the bus service guiding system 1A to be constructed at further low costs. Not only such the e-mail address but also a URL may be used, that is, after the browser is run, the URL may be input to make access to a home page of the information providing service center 3. Guidance information may be provided in a manner so as to contain information about change and/or transit of a shuttle bus A or a like.

Moreover, the bus service guiding system 1A may be constructed so that a generalized management organization joined by a plurality of bus companies C, C, . . . is established so as to manage the information providing service center, which enables a most suitable shuttle bus and/or get-off bus stop or a like out of shuttle buses managed by the plurality of bus companies to be selected irrespective of any of the bus companies. That is, the bus service guiding system 1A may be so constructed that the guidance processing server receives, on an ordinary basis, information about bus operations and recommends a shuttle bus, based on the information about bus operations, which runs on a most suitable route leading to a destination of a user B, irrespective of any of the bus companies. This enables a user B to reach a destination rapidly and at low costs and the bus service guiding system 1A is of high utility value at emergency in particular.

Moreover, in the above embodiments, a portable cellular phone is used as the user terminal, however, a communication device having a function as, for example, a PHS (Personal Handyphone System) terminal may be employed. This enables the information providing service center 3 to obtain further precise information about a location of a user terminal. Also, when a request is made asking the information providing service center 3 to provide guidance information, information about a present location of a user terminal 2 (for example, a name of a nearby bus stop, identification number, or a like) may be transmitted at the same time. An identification number of a shuttle bus may be displayed also in the queried-object notifying section 4 and the identification number, when a queried-object address requesting signal is received, may be transmitted to the user terminal 2. An infrared sensor to detect an approach of a user B may be mounted in the queried-object notifying section 4 so that detection of the approach causes preparation for transmission of e-mail address information to be initiated. Furthermore, in the above second embodiment, information about a traffic jam to be used when the information providing service center 3 creates guidance information may be acquired from an independent operation managing system.

What is claimed is:

1. A transport vehicle service guiding system for providing a user with guidance information about a transport vehicle running on a regular route to have said user get on or off at any one of specified vehicle stops, said guiding system comprising:

a user terminal being movable and to be used by said user, a guidance information providing center to provide said guidance information in response to a request from said user terminal, which is able to carry out communications with said user terminal through a network;

a vehicle-installed communicating unit being mounted on said transport vehicle and being able to carry out communications with said user terminal at least within said transport vehicle;

wherein said user terminal transmits information about a destination to said guidance information providing center through said network and makes a request for corresponding said guidance information;

wherein said guidance information providing center, in response to a request from said user terminal, provides said guidance information to said user terminal through said network; and wherein said vehicle-installed communicating unit, when having received a get-off guidance request created based on said guidance information from said user terminal, transmits get-off guidance information to said user terminal.

2. The transport vehicle service guiding system according to claim 1, wherein said vehicle-installed communicating unit is able to carry out near-distance communications in which a communication range is limited to an inside and vicinity of said transport vehicle, with said user terminal.

3. The transport vehicle service guiding system according to claim 2, wherein said user terminal and said vehicle-installed communicating unit transmit and receive specified information by communications using Bluetooth technology or by infrared communications.

4. The transport vehicle service guiding system according to claim 1, wherein said information about a destination contains keywords related to said destination.

5. The transport vehicle service guiding system according to claim 1, further comprising a queried-object notifying unit being placed in at least one of said specified vehicle stops for said transport vehicle and used to notify queried-object information of said guidance information providing center.

6. The transport vehicle service guiding system according to claim 5, wherein said queried-object notifying unit, in response to a request from said user terminal, transmits said queried-object information to said user terminal.

7. The transport vehicle service guiding system according to claim 1, wherein said vehicle-installed communicating unit, based on a run-distance of said transport vehicle, when said transport vehicle approaches a destination, transmits said get-off guidance information to said user terminal.

8. A transport vehicle service guiding system for providing a user with guidance information about a transport vehicle running on a regular route to have said user get on or off at any one of specified vehicle stops, said guiding system comprising:

a user terminal being movable and to be used by said user;

a guidance information providing center to provide said guidance information about said transport vehicle in response to a request from said user terminal, which is able to carry out communications with said user terminal through a network;

wherein said user terminal transmits information about a destination through said network to said guidance information providing center and makes a request for corresponding said guidance information and, based on provided guidance information, determines timing for guiding said user in getting out of said transport vehicle and, when said transport vehicle approaches said destination, gives notification to prompt said user to prepare for getting out of said transport vehicle.

9. A transport vehicle service guiding method for providing a user with guidance information about a transport vehicle running on a regular route to have said user get on or off at any one of specified vehicle stops, said guiding method comprising:

a step of carrying out communications by connecting, through a network, a user terminal being movable and to be used by said user to a guidance information providing center to provide said guidance information about said transport vehicle in response to a request from said user terminal;

a step of carrying out communications between a vehicle-installed communicating unit being mounted on said transport vehicle and said user terminal at least within said transport vehicle;

wherein said user terminal transmits information about a destination to said guidance information providing center through said network and makes a request for corresponding said guidance information;

wherein said guidance information providing center, in response to said request from said user terminal, provides said guidance information through said network to said user terminal; and wherein said vehicle-installed communicating unit, when having received a request for get-off guidance created based on said guidance information from said user terminal, transmits get-off guidance information to said user terminal.

10. The transport vehicle service guiding method according to claim 9, wherein said vehicle-installed communicating unit is able to carry out near-distance communications in which a communication range is limited to an inside and vicinity of said transport vehicle, with said user terminal.

11. The transport vehicle service guiding method according to claim 10, wherein said user terminal and said vehicle-installed communicating unit transmit and receive specified information by communications using Bluetooth technology or by infrared communications.

12. The transport vehicle service guiding method according to claim 9, wherein said information about a destination contains keywords related to said destination.

13. The transport vehicle service guiding method according to claim 9, wherein a queried-object notifying unit being placed in at least one of specified vehicle stops for said transport vehicle notifies queried-object information of said guidance information providing center.

14. The transport vehicle service guiding method according to claim 13, wherein said queried-object notifying unit, in response to a request from said user terminal, transmits said queried-object information to said user terminal.

15. The transport vehicle service guiding method according to claim 9, wherein said vehicle-installed communicating unit, based on a run-distance of said transport vehicle, when said transport vehicle approaches a destination, transmits said get-off guidance information to said user terminal.

16. A transport vehicle service guiding method for providing a user with guidance information about a transport vehicle running on a regular route to have said user get on or off at any one of specified vehicle stops, said guiding method comprising:

a step of carrying out communications by connecting, via a network, a user terminal being movable and to be used by said user to a guidance information providing center to provide said guidance information about a transport vehicle in response to a request from said user terminal; and wherein said user terminal transmits information about a destination through said network to said guidance information providing center and makes a request for corresponding said guidance information about said transport vehicle and, based on provided guidance information, determines timing for guiding said user in getting out of said transport vehicle and, when said transport vehicle approaches said destination, gives notification to prompt said user to prepare for getting out of said transport vehicle.

17. A transport vehicle service guiding program to have a computer execute a transport vehicle service guiding method for providing a user with guidance information about a transport vehicle running on a regular route to have said user get on or off at any one of specified vehicle stops, said guiding method comprising:

a step of carrying out communications by connecting, through a network, a user terminal being movable and to be used by said user to a guidance information providing center to provide said guidance information about said transport vehicle in response to a request from said user terminal;

a step of carrying out communications between a vehicle-installed communicating unit being mounted on said transport vehicle and said user terminal at least within said transport vehicle;

wherein said user terminal transmits information about a destination to said guidance information providing center through said network and makes a request for corresponding said guidance information;

wherein said user terminal transmits information about a destination to said guidance information providing center through said network and makes a request for corresponding said guidance information;

wherein said guidance information providing center, in response to said request from said user terminal, provides said guidance information through said network to said user terminal; and wherein said vehicle-installed communicating unit, when having received a request for get-off guidance created based on said guidance information from said user terminal, transmits get-off guidance information to said user terminal.

18. A transport vehicle service guiding program to have a computer execute a transport vehicle service guiding method for providing a user with guidance information about a transport vehicle running on a regular route to have said user get on or off at any one of specified vehicle stops, said guiding method comprising:

a step of carrying out communications by connecting, via a network, a user terminal being movable and to be used by said user to a guidance information providing center to provide said guidance information about a transport vehicle in response to a request from said user terminal; and wherein said user terminal transmits information about a destination through said network to said guidance information providing center and makes a request for corresponding said guidance information about said transport vehicle and, based on provided guidance information, determines timing for guiding said user in getting out of said transport vehicle and, when said transport vehicle approaches said destination, gives notification to prompt said user to prepare for getting out of said transport vehicle.

19. A transport vehicle service guiding system for providing a user with guidance information about a transport vehicle running on a regular route to have said user get on or off at any one of specified vehicle stops, said guiding system comprising:

a user terminal being movable and to be used by said user, a guidance information providing means to provide said guidance information in response to a request from said user terminal, which is able to carry out communications with said user terminal through a network;

a vehicle-installed communicating means being mounted on said transport vehicle and being able to carry out communications with said user terminal at least within said transport vehicle;

wherein said user terminal transmits information about a destination to said guidance information providing means through said network and makes a request for corresponding said guidance information;

wherein said guidance information providing means, in response to a request from said user terminal, provides said guidance information to said user terminal through said network; and wherein said vehicle-installed communicating means, when having received a get-off guidance request created based on said guidance information from said user terminal, transmits get-off guidance information to said user terminal.

20. The transport vehicle service guiding system according to claim 19, wherein said vehicle-installed communicating means is able to carry out near-distance communications in which a communication range is limited to an inside and vicinity of said transport vehicle, with said user terminal.

21. The transport vehicle service guiding system according to claim 20, wherein said user terminal and said vehicle-installed communicating means transmit and receive specified information by communications using Bluetooth technology or by infrared communications.

22. The transport vehicle service guiding system according to claim 19, wherein said information about a destination contains keywords related to said destination.

23. The transport vehicle service guiding system according to claim 19, further comprising a queried-object notifying means being placed in at least one of said specified vehicle stops for said transport vehicle and used to notify queried-object information of said guidance information providing means.

24. The transport vehicle service guiding system according to claim 23, wherein said queried-object notifying means, in response to a request from said user terminal, transmits said queried-object information to said user terminal.

25. The transport vehicle service guiding system according to claim 19, wherein said vehicle-installed communicating means, based on a run-distance of said transport vehicle, when said transport vehicle approaches a destination, transmits said get-off guidance information to said user terminal.

26. A transport vehicle service guiding system for providing a user with guidance information about a transport vehicle running on a regular route to have said user get on or off at any one of specified vehicle stops, said guiding system comprising:

a user terminal being movable and to be used by said user, a guidance information providing means to provide said guidance information about said transport vehicle in response to a request from said user terminal, which is able to carry out communications with said user terminal through a network;

wherein said user terminal transmits information about a destination through said network to said guidance information providing means and makes a request for corresponding said guidance information and, based on provided guidance information, determines timing for guiding said user in getting out of said transport vehicle and, when said transport vehicle approaches said destination, gives notification to prompt said user to prepare for getting out of said transport vehicle.

* * * * *